United States Patent [19]

Kümmel

[11] Patent Number: 4,546,821

[45] Date of Patent: Oct. 15, 1985

[54] HEAT EXCHANGER WITH BULK MATERIAL RETARDER SYSTEM

[76] Inventor: Joachim Kümmel, Tuerkisweg 4, D-4044 Kaarst 2, Fed. Rep. of Germany

[21] Appl. No.: 624,295

[22] Filed: Jun. 25, 1984

[51] Int. Cl.[4] ..... F28C 3/10; F26B 17/12; B65D 47/00

[52] U.S. Cl. ..... 165/96; 165/920; 34/165; 34/167; 34/176; 34/177; 222/547; 222/561

[58] Field of Search ..... 165/96, DIG. 27; 34/167, 176, 177, 168, 165, 170; 222/199, 200, 485, 544, 547, 559, 561

[56] References Cited

U.S. PATENT DOCUMENTS

| | | | |
|---|---|---|---|
| 117,718 | 8/1971 | Pefrey | 222/199 |
| 940,190 | 11/1909 | Provost | 34/177 |
| 1,000,120 | 8/1911 | Provost | 34/176 |
| 2,386,670 | 10/1945 | Evans | 34/167 |
| 2,412,136 | 12/1946 | Evans et al. | 34/168 |
| 2,434,202 | 1/1948 | Evans et al. | 34/170 |
| 2,507,604 | 5/1950 | Lawson | 165/96 |
| 2,553,561 | 5/1951 | Evans | 34/168 |
| 2,642,206 | 6/1953 | Reed | 34/165 |
| 2,697,654 | 12/1954 | Evans | 34/170 |
| 3,031,773 | 5/1962 | Dunkle | 165/134 R |
| 3,537,511 | 11/1970 | Maag | 34/177 |
| 3,633,489 | 1/1972 | Spoelhof | 222/485 |
| 4,439,933 | 4/1984 | Dietrich et al. | 34/168 |

FOREIGN PATENT DOCUMENTS

| | | | |
|---|---|---|---|
| 211696 | 2/1924 | United Kingdom | 34/167 |

*Primary Examiner*—William R. Cline
*Assistant Examiner*—John K. Ford
*Attorney, Agent, or Firm*—Shlesinger Arkwright Garvey & Fado

[57] ABSTRACT

A heat exchanger consisting of a housing (1) with integrated caloric surfaces (3) for cooling bulk materials (8)—in particular hot foundry molding sands—comprises a retarder system in the form of a sand cascade which consists of an upper perforated plate (9) with many small individual holes (11), of a lower perforated plate (12) with few individual holes (12), said perforated plates being spaced apart by perforated plates (4,15), the sand flow through the slide system (5,6,14) being controllable and sealable.

The passage holes may assume the shapes of triangular, longitudinal or T slots in order to operate such a retarder cooler over a large range of regulation.

The perforated spacer plates (4) moreover form a support plate with high static load capacities to absorb the substantial weights of the bulk materials.

The holes (15) of the spacer plates (4) allow the retarded material to flow and float in the cascade chambers and thereby assure the transit of the bulk material in uniform manner through the upper cascade plate holes (11) for all loads.

4 Claims, 2 Drawing Figures

HEAT EXCHANGER WITH BULK MATERIAL RETARDER SYSTEM

The invention relates to a heat exchanger for cooling fine-grained bulk materials, in particular sand (for instance molding sand), consisting of a housing with integrated heat-exchanging (cooling) surfaces and with a downstream retarder system for the bulk material.

The cooling of bulk materials, in particular of foundry molding sands, is done by so-called retarder coolers in which the bulk material to be cooled is moved slowly past the cooling surfaces.

The bulk material is moved by gravity, with the retarder system implementing a constant flow rate.

In the known retarder coolers, the bulk material is made to pass underneath the cooling surface through slots or holes with the rate of flow of the material being adjusted by inverted cone-shaped regulators vertically displaceable with respect to the holes.

These cooling systems incur the drawback that it is impossible to automate the rate at which the bulk material passes through.

Furthermore individual channels are formed by the above-mentioned cone-shaped regulators and the sand temperature cannot be kept constant at the discharge. The heating surface of the cooler system must be made substantially larger.

Other retarder coolers of the described kind include a retarding system which consists of two superposed perforated plates, the upper perforated plate being solidly clamped in position while the lower perforated plate acts as a sealing and adjusting slide means.

Perforated plates are characterized by assuring regulation only within very narrow limits and the two plates must be mounted very close to each other.

The gap between the plates quickly fills with sand after very brief shutdown times, whereupon the lower slide means can be moved only upon exerting a very high force. Moreover the retarder systems entail substantial erosion.

It is the object of the invention to so design a retarder cooler of the initially cited type that it assures a uniform sand flow rate, that it can be regulated within wide limits, and that it can also be used as a quick-connect means.

Furthermore the retarder system shall be insensitive to variable flow properties of the bulk material.

This problem is solved by the invention in that the bulk material initially is made to flow through a sifting surface with uniformly distributed passage perforations and is guided into a plurality of chambers, each chamber comprising a single passage with a substantial diameter.

A slide system is mounted underneath these discharge holes, whereby the moving sand can be controlled over a wide range of regulation depending on the position of the slide means.

Furthermore the slide means can also be displaced in such a manner underneath the lower perforated plate that complete sealing is achieved.

Initially, the sand is made to pass through uniformly distributed passage perforations in an upper cascade plate in the form of a cascade. While the slide position underneath the second cascade plate can still form craters and channels in the sand flow, this will only be the case in the region of the individual chambers underneath the upper perforated plate. The different transits of sand no longer can lodge themselves into the heat exchange system.

The retarder cooler of the invention is suited for both low and high flow rates and surprisingly also is suitable for cooling bulk materials with minimal angles or repose without problems of regulation or transit being raised.

Another advantage of the retarder cooler of the invention is the enhanced range of regulation. A control range of 0–100% flow can be achieved in a problem-free manner by making the slide system move in oscillating manner.

This requirement could not be met by coolers of the heretofore known design.

Furthermore the heat exchanger is more insensitive to erosion because the distance of the slider from the lower cascade plate can be selected to be very large. This is especially important when bulk materials with a very wide grain structure and of high hardness must be cooled. This problem could not be solved by the coolers of the prior design.

In a further feature of the invention vertically positioned perforated plates are provided as supports between the upper and lower cascade plates to offset the weight of the bulk material residing thereon.

Moreover the said spaced perforated plates also prevent crater-like accumulation within the individual cascade chambers by allowing sand to flow into adjacent cascade chambers.

Figure 1:
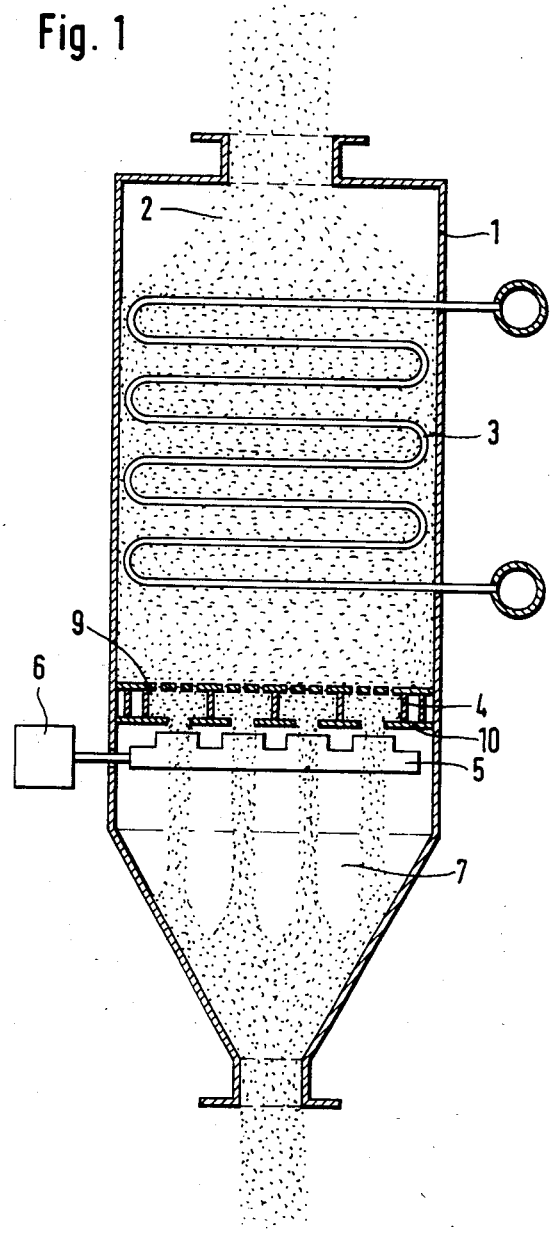
FIG. 1 is a longitudinal section of the heat exchanger, shown in diagrammatical form, with the retarder system.

The heat exchanger shown in FIG. 1 consists of a housing 1 (preferably a steel plate housing), the intake 2 for the bulk material, the heat exchanger 3, with a cooling medium passing through said exchanger.

The retarder system comprises a cascade buffer zone bounded by upper cascade plate 9 and lower cascade plate 10 and a slide mechanism 5 beneath plate 10. The slide mechanism 5 is powered by a drive unit 16 and may be regulated for partial or total throttling of the flow streams.

The draining sand moves from the funnel 7 out of the cooler.

Figure 2:
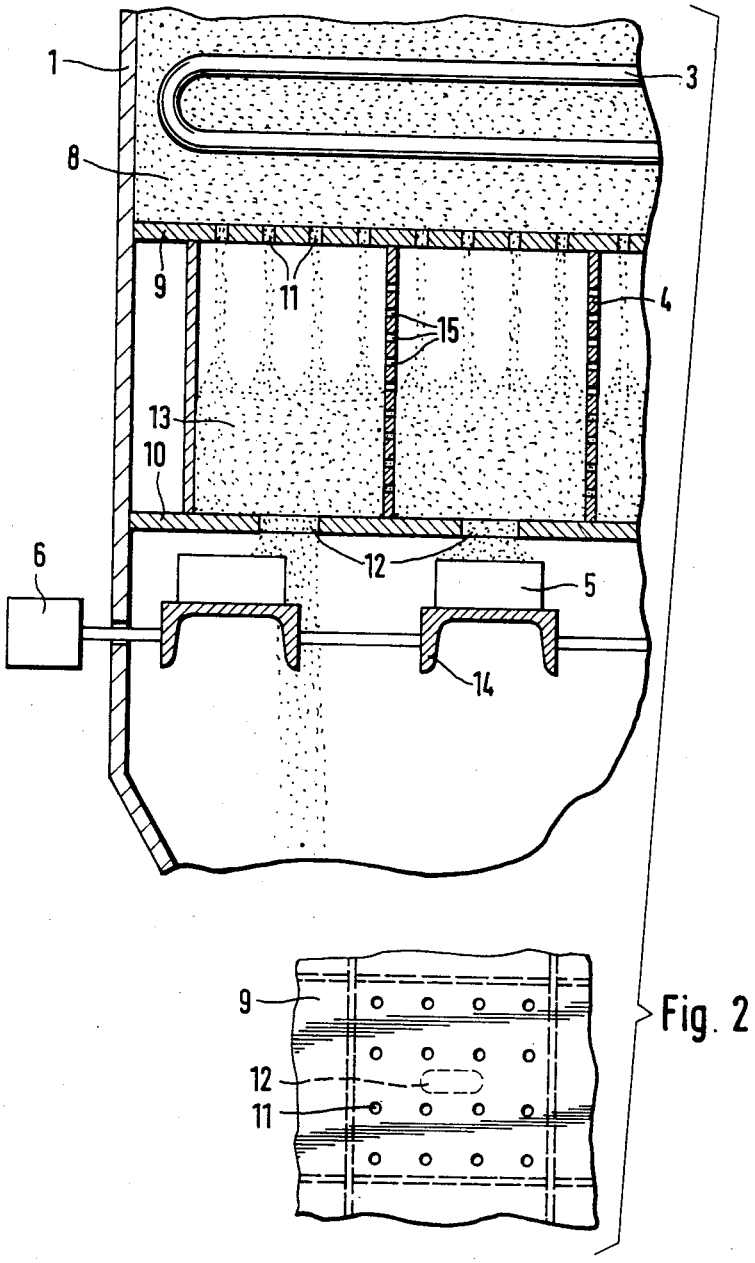
FIG. 2 is a longitudinal section of the retarder system representing operation and design of the sand cascade.

The fragmentary drawing of FIG. 2 essentially represents the cooler housing 1 with the heat exchanger system 3 with a more detailed view of the retarder system comprising the cascade buffer zone and the slide system.

The bulk material 8 which is to be cooled passes through the uniformly arranged holes 11 of the upper cascade plate 9 into the cascade buffer zone. The buffer zone is further partitioned into individual cascade chambers 13 by means of vertically positioned perforated plates 4.

The bulk material leaves the cascade chambers 13 through the holes 12 of the lower cascade plate 10. Variable position of the slide 5 underneath the cascade holes 12 is controlled by the setting drive 6. The slides 5 are supported on a foundation 14. The FIG. 2 also shows both the slide closure position and a slide transmitting position.

The spacer plates 4 of the sand cascade consist of perforated plates. Due to the perforations 15 in spacer plates 4, sand may flow between adjacent chambers 13, thus preventing the formation of asymmetric craters by the sand in any one of the chambers even when the exit openings 12 are significantly throttled by slides 5.

The bulk material flows or floats through the holes into the neighboring chambers. Due to this circumstance the bulk-material passage holes 11 of the upper cascade plate 9 remain always clear, even for the least flow rate, and consequently the transit of the bulk material in the cooler system always takes place uniformly for all loads and even for the most diverse grains.

The design of the lower passage holes 12 of the sand cascade is another illustrative feature of the invention.

When these passage holes are designed as triangular, longitudinal or T slots, they no longer affect the crater formation above the cascade plate 9, but instead enhance and refine the control characteristics of the regulating slide 5,6,14.

Obviously the slider 5 also may be designed in the form of a vertically moving frustrum-of-cone.

However this solution is operative only for modest cooling units.

Preferably there are between 9 and 25 cascade passage holes 11 in the upper cascade plate 9 for each hole 12 in lower cascade plate 10.

In addition, the area of each passage hole 12 is between 8 and 16 times the area of each hole 11.

I claim:

1. Apparatus for controlling the flow characteristics of bulk material through a heat exchange structure, comprising:

(a) a housing including a top wall and side walls, (b) an inlet in said top wall for receiving bulk material, (c) said side walls extending downwardly from said top wall terminating at a discharge funnel, (d) said housing defining an internal space for directing the flow of said bulk material, (e) said internal space including an upper zone and a lower zone, (f) a heat exchanger positioned in said upper zone, (g) an upper cascade plate extending between said side walls and situated between said upper zone and said lower zone, (h) said upper cascade plate including a plurality of openings formed therein, (i) a lower cascade plate extending between said side walls spaced from and positioned beneath said upper cascade plate, (j) said lower cascade plate having a plurality of openings, the number of openings being substantially less than the number of openings in said upper cascade plate, and the size of said openings being substantially greater than the size of said openings in said upper cascade plate, (k) a plurality of perforated spacer plates extending vertically between said upper and said lower cascade plates, and together with said upper and said lower cascade plates forming a plurality of intercommunicating cascade chambers, (l) each of said openings in said lower cascade plate forming a centrally located discharge passage for each of said cascade chambers, and (m) movable flow regulating means situated beneath said lower cascade plate for controlling the accumulation of bulk material in said cascade chambers.

2. Apparatus as in claim 1, wherein:

(a) said upper cascade plate having between 9 and 25 openings formed therein for each opening in said lower cascade plate.

3. Apparatus as in claim 1, wherein:

(a) each opening in said lower cascade plate having a cross-sectional area of between 8 and 16 times the cross-sectional area of each opening in said upper cascade plate.

4. Apparatus as in claim 1, wherein:

(a) said movable flow regulating means comprising a plurality of interconnected slide members corresponding in number to the number of said second openings, and (b) said slide members being located and maintained at a predetermined distance beneath said lower cascade plate and movable into the flow path of bulk material exiting from said second openings of said lower cascade plate for partial or total throttling of said bulk material exiting from said second openings.

* * * * *